US011813878B2

(12) United States Patent
Iwasaki

(10) Patent No.: US 11,813,878 B2
(45) Date of Patent: Nov. 14, 2023

(54) PRINTER WITH PRINTHEAD REPLACEMENT DETECTION AND METHOD FOR PRINTHEAD REPLACEMENT DETECTION

(71) Applicant: TOSHIBA TEC KABUSHIKI KAISHA, Tokyo (JP)

(72) Inventor: Fumiharu Iwasaki, Sunto Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/742,234

(22) Filed: May 11, 2022

(65) Prior Publication Data

US 2023/0014175 A1 Jan. 19, 2023

(30) Foreign Application Priority Data

Jul. 16, 2021 (JP) ..... 2021-117800

(51) Int. Cl.
*B41J 2/355* (2006.01)

(52) U.S. Cl.
CPC ..... *B41J 2/3553* (2013.01); *B41J 2202/31* (2013.01); *B41J 2202/37* (2013.01)

(58) Field of Classification Search
CPC .. B41J 2/3553; B41J 2202/31; B41J 2202/37; B41J 2/32; B41J 2/355; B41J 2/315
See application file for complete search history.

(56) References Cited

U.S. PATENT DOCUMENTS

2020/0307290 A1 10/2020 Minami

FOREIGN PATENT DOCUMENTS

JP 2008201017 A 9/2008

OTHER PUBLICATIONS

Extended European Search Report dated Nov. 18, 2022, mailed in counterpart European Application No. 22180388.5, 9 pages.

*Primary Examiner* — Kristal Feggins
(74) *Attorney, Agent, or Firm* — Kim & Stewart LLP

(57) ABSTRACT

According to an embodiment, a printer includes a thermal head with a plurality of heaters. A memory device stores utilization information indicating a status or cumulative usage amount of the thermal head. A processor is configured to acquire a measured resistance value for each of the heaters in the plurality of heaters and detect whether the thermal head has been changed since a previous use based on differences in the measured resistance values from reference resistance values. If it is detected that the thermal head has been changed, the processor updates the utilization information in the memory device to indicate the thermal head has been replaced.

17 Claims, 5 Drawing Sheets

| ORDINAL NUMBER OF MEASUREMENT \ HEATER NUMBER | 1 | 2 | 3 | 4 | 5 | 6 | 7 |
|---|---|---|---|---|---|---|---|
| 1 | 740 | 741 | 742 | 743 | 744 | 745 | 746 |
| 2 | 740 | 741 | 742 | 743 | 744 | 745 | 746 |
| ⋮ | ⋮ | ⋮ | ⋮ | ⋮ | ⋮ | ⋮ | ⋮ |
| N | 720 | 721 | 722 | 723 | 724 | 725 | 726 |
| N+1 | 752 | 751 | 750 | 749 | 748 | 747 | 746 |
| ⋮ | ⋮ | ⋮ | ⋮ | ⋮ | ⋮ | ⋮ | ⋮ |

PRINTER WITH PRINTHEAD REPLACEMENT DETECTION AND METHOD FOR PRINTHEAD REPLACEMENT DETECTION

CROSS-REFERENCE TO RELATED APPLICATION

This application is based upon and claims the benefit of priority from Japanese Patent Application No. 2021-117800, filed Jul. 16, 2021, the entire contents of which are incorporated herein by reference.

FIELD

Embodiments described herein relate generally to a printer and more particularly for detecting a replacement of a printhead of a printer and a method therefor.

BACKGROUND

A printer is known that prints a text or the like on thermal paper using a linear thermal head ("printhead") with a plurality of heat generation elements arranged in a row that intersects the direction in which the paper is conveyed past the thermal head. The printer applies heat from the heat generation elements to the thermal paper which causes a thermally sensitive component of the thermal paper to change color so as to print thereon. Such a printer may be referred to as a thermal printer in some instances.

When the thermal printhead is replaced, information regarding the use of the thermal head) (e.g., the total length of paper printed by the printhead) in the printer or the like must generally be re-initialized or reset. In related art, a technique of recording a replacement history to a component inside the printer after replacing the thermal printhead and thus the performing the initialization or resetting of the prior use information according to the replacement history has been used.

However, with such a technique, since the replacement history must be recorded, the initialization takes additional time and effort for an operator who has to cause the replacement history to be recorded. Thus, in some instances, the replacement might not be recorded and therefore the printhead usage (e.g., a length of paper printed or "distance travelled") cannot be initialized. In other instances, the recording associated with the printhead change event might fail.

DETAILED DESCRIPTION

Certain embodiments describes a printer that automatically detects the replacement of a thermal printhead and thus can simplify the replacement operation. A method for a printer to simplify thermal printhead replacement operations by detection of a replacement event is also described.

According to an embodiment, a printer includes a thermal head, a memory device, and a processor. The thermal head has a plurality of heaters arranged, for example, in a line or the like. The memory device stores utilization information that indicates a status or cumulative usage amount of the thermal head. The processor is configured to acquire a measured resistance value for each of the heaters in the plurality of heaters and detect whether the thermal head has been changed since a previous use based on differences in the measured resistance values from reference resistance values. If it is detected by the processor that the thermal head has been changed, the processor is configured to update the utilization information in the memory device to indicate the thermal head has been replaced.

First Embodiment

Figure 1:
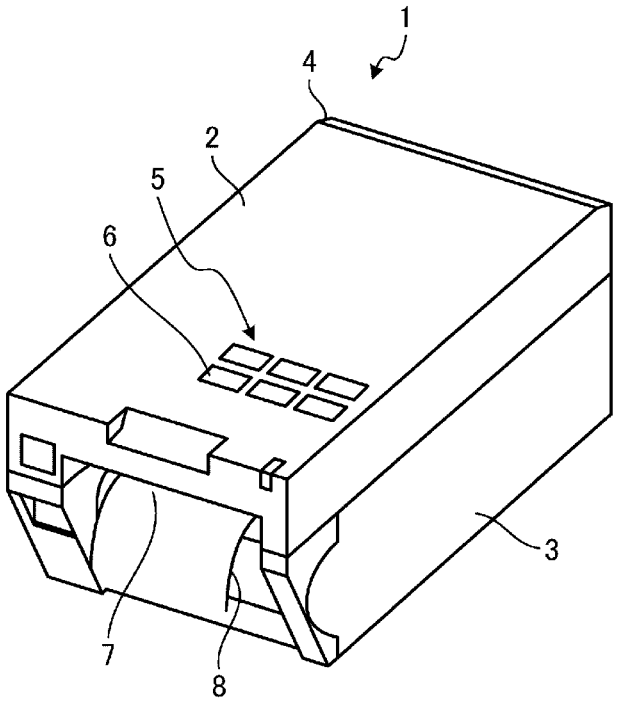
FIG. 1 depicts a printer in a perspective view according to a first embodiment.

A thermal printer 1 (also referred to as "printer 1" for simplicity) according to a first embodiment will now be described with reference to FIGS. 1 to 6. FIG. 1 is a perspective view of thermal printer 1. The thermal printer 1 can be connected to an upper-level device, such as a point-of sale (POS) terminal, and functions as a receipt printer that receives transaction information or the like in the form of printing data from the POS terminal and prints a receipt accordingly. This is one example of usage of the printer 1. The printer 1 may be used by other ways or in other fields or may have other applications. Also, the printer 1 may acquire or receive printing data from other devices than a POS terminal or by other methods than direct connection.

As shown in FIG. 1, the printer 1 has an upper casing 2 and a lower casing 3. The upper casing 2 is provided in a rotationally movable manner on the lower casing 3. The upper casing 2 is, for example, hinged at the end side 4 serving as a rotational axis. As the upper casing 2 can be rotated from the state shown in FIG. 1 so the inside of the printer 1 is opened. At an upper surface of the upper casing 2, an operation unit 5 is provided.

The operation unit 5 has a plurality of operation buttons 6. The operation unit 5 allows various instructions to be input to the printer 1, including a power-on instruction and a power-off instruction. Some or all of the operation buttons 6 have a light-emitting unit. The light-emitting unit is formed by a light-emitting diode (LED), for example. The printer 1 also has a dispensing port 7. The dispensing port 7 discharges a printed receipt 8 from inside the printer 1 to the outside.

Figure 2:
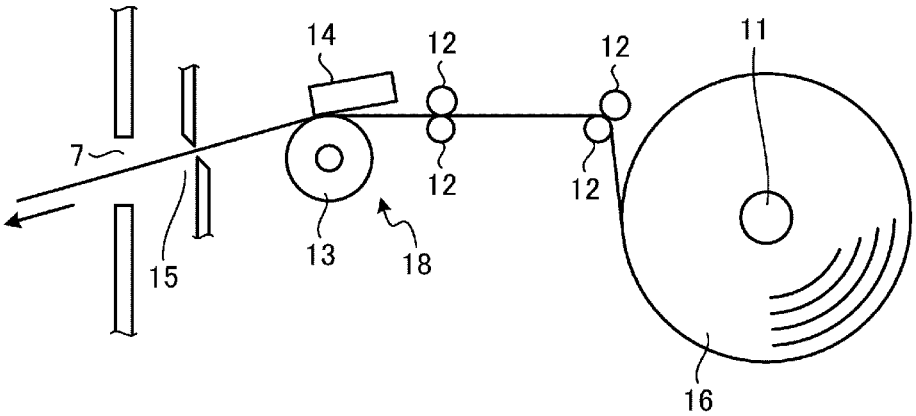
FIG. 2 depicts part of an internal configuration of a printer according to a first embodiment.

As shown in FIG. 2, the printer 1 has, in its inside, a holding unit 11, a plurality of guide rollers 12, a platen 13, a thermal head 14, and a cutter 15 (formed by a pair of blades in this example). Other components, elements, or the like may be provided to the printer 1 as appropriate.

The holding unit 11 holds a thermal paper 16 roll. The guide rollers 12 guide the thermal paper 16 from the holding unit 11 to a space between the platen 13 and the thermal head 14. These guide rollers 12 in this example are provided in two pairs along a conveyance path extending from the holding unit 11 to the space between the platen 13 and the thermal head 14.

The platen 13 rotates, driven by a conveyance motor as a drive source. When the platen 13 rotates, the thermal paper 16 between the platen 13 and the thermal head 14 unrolls from the holding unit 11 and the thermal paper 16 is conveyed past the thermal head 14. The conveyance motor is formed by a stepping motor, for example. The platen 13 and the conveyance motor together form a conveyor unit 18 for conveying the thermal paper 16.

The thermal head 14 is a linear thermal head in which a plurality of heat generation elements (also referred to as heaters) are provided in a line (row) along a direction intersecting (in the present embodiment, orthogonal to) the direction of conveyance of the thermal paper 16. That is, in FIG. 2, the row of heaters extends into the page. The thermal head 14 is pressed with a predetermined force toward the platen 13. The heat generation elements of the thermal head 14 generate heat when power is supplied thereto and the heat (thermal energy) is applied to the thermal paper 16 at selective positions, and thus information (e.g., text or the like) prints on the thermal paper 16 row-by-row as it the thermal paper 16 is conveyed by the conveyor unit 18.

The cutter 15 is formed by a combination of a fixed blade and a moving blade that have the same flat plate-like shape. The cutter 15 slides the moving blade in relation to the fixed blade and thus can cut the thermal paper 16 at any position as the thermal paper is conveyed by the conveyor unit 18. In FIG. 2, the fixed blade is arranged on the upper side in the illustration and the moving blade is arranged on the lower side in the illustration.

The moving blade is driven by a cutter motor and is also movable in the up-down direction in FIG. 2. When the moving blade is in its lowered position, the thermal paper 16 can pass through a space left between the moving blade and the fixed blade. When cutting is to be performed, the moving blade moves upward towards the fixed blade for cutting the thermal paper 16. After the thermal paper 16 has been cut by the cutter 15, it is dispensed as a receipt 8 from the dispensing port 7.

Figure 3:
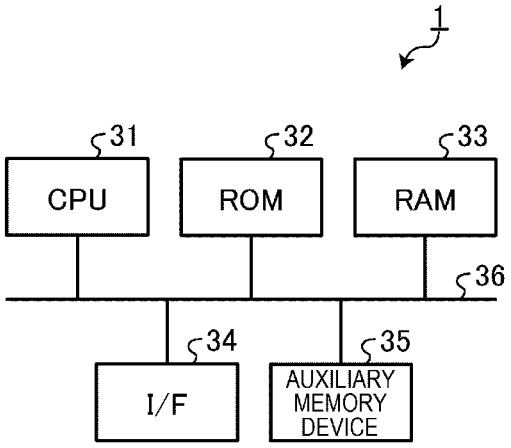
FIG. 3 is a configuration block diagram of a printer according to a first embodiment.

As shown in FIG. 3, the printer 1 includes a central processing unit (CPU) 31, a read-only memory (ROM) 32, a random-access memory (RAM) 33, an interface (I/F) 34, and an auxiliary memory device 35 that are connected to each other via a bus 36. Other components, elements, or the like may be connected via the bus 36 as appropriate.

The CPU 31 is a computing device that controls operations of the printer 1. The CPU 31 is an example of a processor in the printer 1 according to the present embodiment. Another processor type or processing circuit may be provided instead of a CPU 31. The ROM 32 stores a program or the like for implementing various kinds of processing with the CPU 31. The RAM 33 is, for example, a main memory of the printer 1 and stores data that is necessary for the various kinds of processing by the CPU 31.

The I/F 34 is for transmitting and receiving data. The I/F 34 is also for communicating with the POS terminal, the upper-level device to which the printer 1 is connected to function as its receipt printer in the present embodiment. The auxiliary memory device 35 stores various data, such as a program or the like, to be executed by the CPU 31. The auxiliary memory device 35 also stores utilization information of the thermal head 14. The auxiliary memory device 35 is formed, for example, by a rewritable non-volatile memory medium, such an electrically erasable programmable read-only memory (EEPROM). Also, a part of the area in the ROM 32 may be used as the auxiliary memory device 35.

The utilization information (use information) of the thermal head 14 indicates a utilization state of the thermal head 14 and includes, for example, a distance traveled (the cumulative length of paper printed) by the thermal head 14. As one example of a value or measurement that can be used as the distance traveled, the total number of steps made by the conveyance motor (which is a stepping motor in this example) for rotationally driving the platen 13 while the thermal head is installed or a counted value of the total number of rotations of the platen 13 during printing with the thermal head 14 may be recorded. The utilization information may include the replacement history (for example, date and time of a replacement) or the like for thermal heads 14. The recording of the utilization information is executed by the CPU 31 or a functional unit implemented by the CPU 31 executing software or the like.

Figure 4:
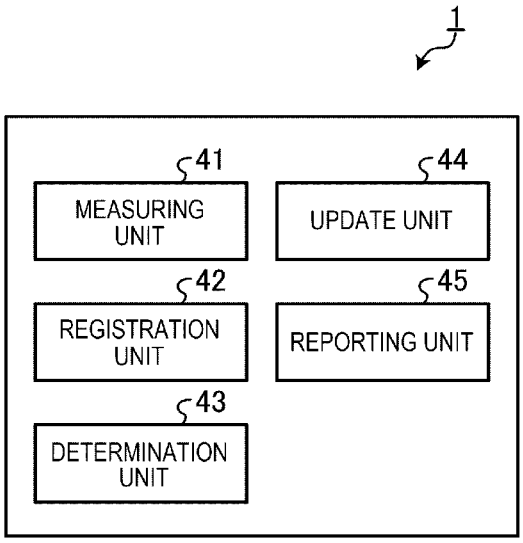
FIG. 4 is a configuration block diagram of a printer according to a first embodiment.

As shown in FIG. 4, as the CPU 31 operates according to the program stored in the ROM 32, the printer 1 can be considered to implement, as functional units, a measuring unit 41, a registration unit 42, a determination unit 43, an update unit 44, and a reporting unit 45. In various examples, these functions may be formed by hardware, software, or combination of hardware and software.

The measuring unit 41 measures the resistance value of each of the heaters in the thermal head 14. For example, the measuring unit 41 measures the resistance values of the heaters each time the printer 1 is started up. The method for measuring the resistance values of the heaters is not particularly limited. Various methods, techniques, or the like can be used in this context.

For example, the measuring unit 41 can apply a predetermined voltage (or supplies a current) to each heater separately and thus measures the resistance value for each heater individually at the startup of the printer 1. Specifically, in this example, the measuring unit 41 acquires the resistance value of each heater as measured via an analog-to-digital (A/D) converter.

The registration unit 42 stores, in the RAM 33 or the like, the measured resistance value for each heater as measured by the measuring unit 41. The registration unit 42 also stores the measured resistance values of each heater into a non-volatile memory medium, such as the auxiliary memory device 35, as reference resistance values. The reference resistance values are measured for particular conditions. The recording of a reference resistance value is referred to as a registration.

In one instance, the registration unit 42 registers the resistance value of a heater measured at an initial startup of the printer 1 into the auxiliary memory device 35 as the reference resistance value. In this context, the initial startup means, for example, when the printer 1 is started up for the first time after being manufactured.

If the determination unit 43 detects that a thermal head 14 has been replaced, the registration unit 42 registers the resistance values measured by the measuring unit 41 as a new reference resistance value. In this way, by registering the reference resistance value, a change in the resistance value of a heater when the thermal head 14 is replaced can be obtained for further analysis.

The determination unit 43 detects whether the thermal head has been replaced, based on the trend in changes between the reference resistance value (as registered by the registration unit 42) and the measured resistance value (as measured by the measuring unit 41). Each heater in the thermal head 14 may be monitored in this manner Generally, in a printer or a thermal printer, certain characteristics of each heater in a thermal head vary from one thermal head to another. For example, the change (trend) in measured resistance value for each heater may be different printhead to printhead and heater to heater. Therefore, by measuring the resistance value of one or more heater in a thermal head 14 and comparing the resistance value trends, it is generally possible to determine whether the thermal head currently installed is the same thermal head as before or whether a different thermal head has been installed. For example, if the trend in the measured resistance value of the heater changes abruptly, it can be determined that the thermal head 14 has been recently replaced.

In the printer 1 according to the present embodiment, the resistance values for the plurality of heaters in a thermal head 14 are stored in the auxiliary memory device 35 whenever the thermal head 14 is replaced. At various points, such as each startup, the determination unit 43 compares the trend of the stored reference resistance values with the resistance values of the individual heaters just measured by the measuring unit 41, and determines whether the thermal head 14 has been changed, based, for example, on a trend in differences between the reference resistance values and the measured resistance values.

Figures 5, 6:
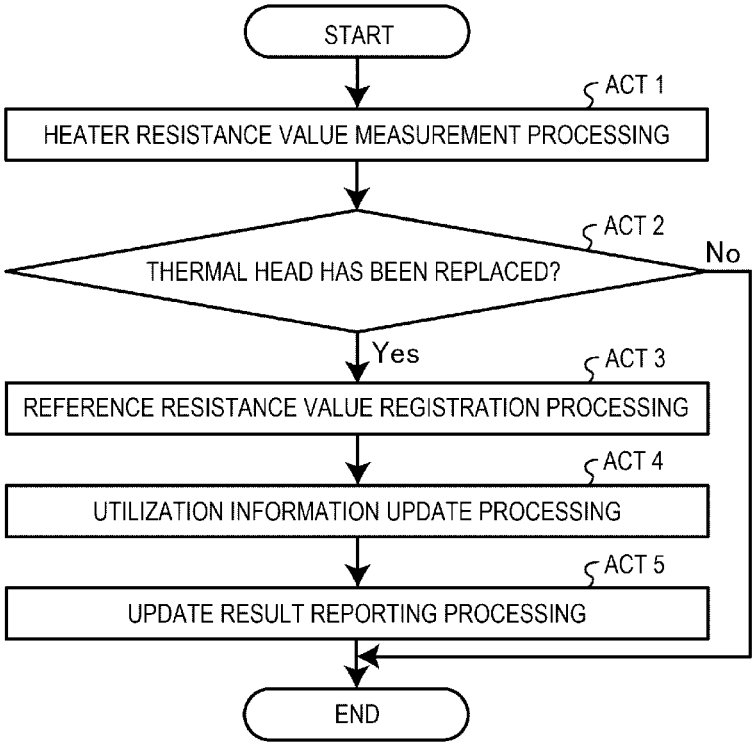
FIG. 5 depicts an example result of measurement of a resistance value according to a first embodiment.
FIG. 6 is a flowchart of processing to be executed by a printer according to a first embodiment.

The processing executed by the determination unit 43 will now be described in conjunction with FIG. 5. FIG. 5 shows the results of the measuring of the resistance values of the individual heaters (#1, #2, . . . #7) by the measuring unit 41 at each startup (1, 2, . . . N, N+1) of the printer 1. The resistance values can be considered to be in arbitrary units of measure in this example. FIG. 5 shows the summary results of a plurality of measurements by the measuring unit 41. However, in some embodiments, just the most recent resistance values measured by the measuring unit 41 might be held in the RAM 33 or the like. In FIG. 5, the resistance values in the first measurement row (ordinal number "1") represent the reference resistance values. In FIG. 5, the heater number column labels correspond to positions of the heaters arranged in the thermal head 14 and thus represent an arrangement order of the heaters.

In one example, the determination unit 43 determines whether the thermal head 14 has been replaced or not, based a change of trend in the measured resistance value of each heater acquired by calculating the difference between the resistance value in the first measurement row and the resistance value in the second measurement ("2" in the second row) for each heater (heater number). In the example, there is no difference (change) in the resistance values of each heater between the first and second measurements, and the trend of the resistance values has not yet changed. Therefore, the determination unit 43 determines that the thermal head 14 has not been replaced between the first and second measurement times.

In another instance, the determination unit 43 calculates the difference the first measurement value and the N-th measurement value for each heater and makes a determination on this basis. In this case, the difference between the resistance values of each heater in the first and N-th measurements is twenty (20) (measurement units), and the value of the difference is substantially equal among all the heaters in the thermal head 14. This change in resistance value is the result of using the printer 1 over time. In this case, the trend in the resistance value changes between the different heaters has not changed overall. Therefore, the determination unit 43 determines that the thermal head 14 has not been replaced.

In still another instance, the determination unit 43 calculates the difference between the first measurement values and the (N+1)th measurement values and makes a determination on this basis. In this case, the resistance value difference between the first and (N+1)th measurements is 12 for the heater 1; 10 for the heater 2; 8 for the heater 3; 6 for the heater 4; 4 for the heater 5; 2 for the heater 6; and 0 for the heater 7, and so on. Therefore, the amount of difference between the resistance values varies from one heater to another. Such a variation means that the trend in the resistance values across the heaters has changed, and the determination unit 43 thus determines that the thermal head 14 has been replaced in view of this change.

In this way, the determination unit 43 compares the resistance value with the reference resistance value and analyzes changes in the resistance value of each heater at the startup of the printer 1. By this comparison, the determination unit 43 can automatically detect that a thermal head 14 has been replaced. While the determination unit 43 calculates the difference between the reference resistance values and the measured resistance values for each heater to make a determination, the determination processing or method is not limited thereto.

The update unit 44 updates the utilization information of the thermal head 14 if the determination unit 43 determines that the thermal head 14 has been replaced. For example, the update unit 44 resets the traveled distance included in the utilization information stored in the auxiliary memory device 35 to 0. Also, for example, the update unit 44 records the date and time of replacement of the thermal head 14 in the utilization information in the auxiliary memory device 35 based on the date and time tracked by a real-time clock (RTC) or the like.

Since the update unit 44 updates the utilization information of the thermal head 14 when the thermal head 14 is replaced, the time and effort of the replacement operation are reduced. Also, because of the automatic update by the update unit 44, there will be no failure to initialize the utilization information, and the replacement operation for the thermal head 14 can be further simplified.

Once the determination unit 43 determines that the thermal head 14 has been replaced, the reporting unit 45 reports the replacement of the thermal head 14. For example, the reporting unit 45 sends a message reporting that the thermal head 14 has been replaced to the POS terminal connected to the printer 1. The POS terminal displays the message on its display device, for example. The reporting unit 45 may also turn on a light-emitting unit in the printer 1 to inform an operator or a user of the printer 1 that the thermal head 14 has been replaced. The method, content, or the like of the report is not limited to this example.

The determination unit 43 and the reporting unit 45 may be two separate units or provided as one functional unit.

An example of an operation flow of the printer 1 will now be described with reference to FIG. 6. In the example, the operation starts when the printer 1 is started up.

First, the measuring unit 41 measures the resistance value of each heater in the thermal head 14 presently installed in the printer 1 (ACT 1).

Next, the determination unit 43 compares the reference resistance value(s) already stored in the auxiliary memory device 35 with the resistance value of each heater as just measured by the measuring unit 41 and determines whether the thermal head 14 has been replaced or not based on changes in the resistance values, heater to heater, or the like (ACT 2).

If the determination unit 43 determines that the thermal head 14 has not been replaced (NO in ACT 2), the processing ends.

If the determination unit 43 determines that the thermal head 14 has been replaced (YES in ACT 2), the processing proceeds to ACT 3.

The registration unit 42 registers new reference resistance values based on the resistance values of the heaters just measured by the measuring unit 41 (ACT 3). The update unit 44 updates the utilization information of the thermal head 14 in the auxiliary memory device 35 (ACT 4). After the update processing is executed, the processing proceeds to ACT 5.

The reporting unit 45 now reports that the thermal head has been replaced (ACT 5). After the reporting, the processing ends.

In the printer 1 according to the present embodiment, the measuring unit 41 measures the resistance value of each heater in the thermal head 14. The determination unit 43 then determines/detects whether the thermal head 14 has been replaced, based changes between the already stored reference resistance values for each heater and the just measured resistance values of each heater. The differences relied on in this context may be changes in the heater-to-heater measured values (heater-to-heater trend) or trends over time in measured differences of the individual heaters. The update unit 44 updates the utilization information if it is determined that the thermal head 14 has been replaced.

Once it is determined that the thermal head 14 has been replaced, the measured resistance value of the heater is registered to serve as a reference resistance value for the next determination processing. From the registration of the reference resistance value, the printer 1 can confirm that the thermal head 14 has been replaced. Also, after the determination of the thermal head replacement, the printer 1 can update the utilization information of the thermal head 14 without failure. Since the utilization information is updated in this way, the operation time can be reduced, and the replacement operation can be simplified.

Second Embodiment

A second embodiment will be described with reference to FIGS. 7 to 9.

Components, elements, units, or configurations same as or similar to those in the first embodiment are denoted by the same reference numbers, and descriptions thereof may be omitted where appropriate.

In the first embodiment, the determination unit 43 directly compares the measured resistance values for each heater to the corresponding reference values to detect the replacement of the thermal head. In the second embodiment, the measured resistance values of the heaters are statistically analyzed to detect the replacement of the thermal head.

Figure 7:
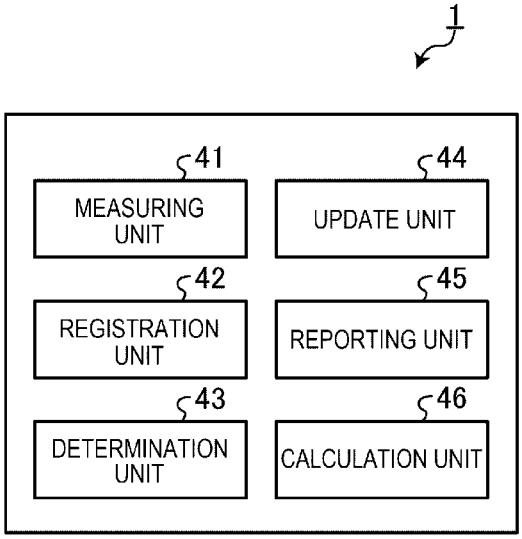
FIG. 7 is a configuration block diagram of a printer according to a second embodiment.

For example, as shown in FIG. 7, the printer 1 according to the second embodiment further includes a calculation unit 46. The calculation unit 46 calculates a trend in the distribution of the resistance values among the heaters of the thermal head 14 based on the resistance values measured by the measuring unit 41.

Figure 8:
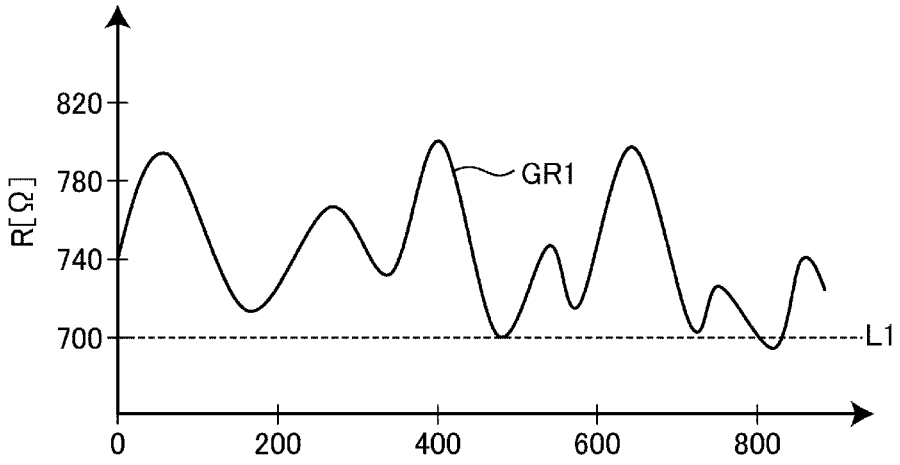
FIG. 8 depicts an example distribution trend of a reference resistance value according to a second embodiment.
Figure 9:
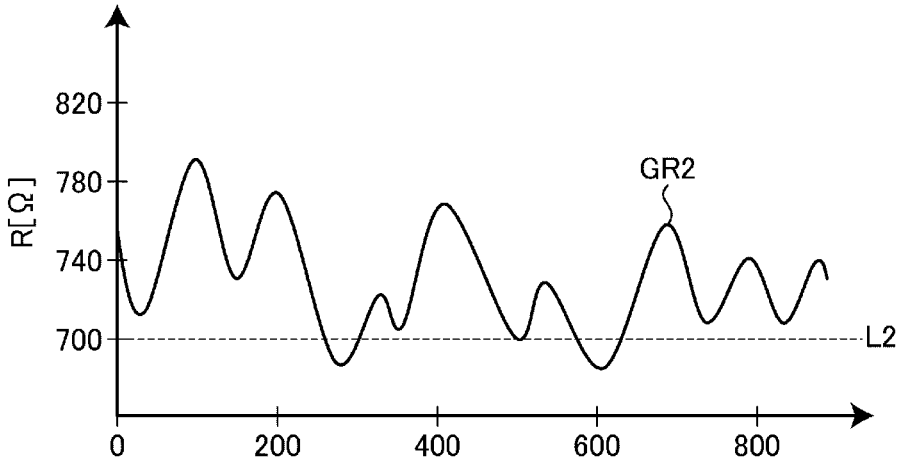
FIG. 9 depicts an example distribution trend of a measured resistance value according to a second embodiment.

Examples of a trend in distribution of the resistance values that might be calculated by the calculation unit 46 are shown in FIGS. 8 and 9.

FIG. 8 shows a graph of measured heater resistance values the horizontal axis is the heater number (position) of each heater being measured and the vertical axis is the resistance value (in ohms (Ω)). The graph line GR1 represents the heater-to-heater trend in resistance values and is considered in this example to be the "reference value" (e.g., first measured values) for the thermal head 14. The calculation unit 46 calculates the values for graph line GR1 as part of the processing for detecting the trend in the distribution of the resistance values across the heaters as measured by the measuring unit 41. The graph line GR1 has seven peaks and six valleys in this example. On the graph line GR1, the resistance value drops below a threshold line L1 (set at 700Ω) at one point (just one valley as a lowest point lower than threshold line L1).

FIG. 9 shows a graph of resistance values measured by the measuring unit 41 for each of the heaters at the (N+1)th measurement. The graph line GR2 in FIG. 9 has eight peaks and eight valleys. On the graph line GR2, the resistance value drops below a threshold line L2 (set at 700Ω) at two points.

In this way, by comparing the distribution of the resistance values of the heaters in the thermal head as calculated by the calculation unit 46, difference between different thermal heads 14 can be readily detected.

The determination unit 43 detects whether the thermal head 14 has been replaced based on the distribution of the reference resistance values and the distribution of the measured resistance values as calculated by the calculation unit 46. For example, by comparing the information corresponding to FIGS. 8 and 9 (e.g., a reference distribution previously measured and a distribution just measured), the determination unit 43 can detect that the thermal head 14 has been replaced because the distributions differ substantially from each other (e.g., different numbers of peaks and/or different number of sub-threshold valleys). Accordingly, the determination unit 43 can automatically and accurately when the replacement of a thermal head 14 has occurred.

The above examples can be modified in various ways by changing a part of the configuration or the function of certain components. Some non-limiting modification examples will be described below as additional embodiments. In the description below, differences from the already described embodiments are mainly described and detailed description of overlapping or substantially similar aspects may be omitted. The modification examples described below may be implemented separately from each other or may be combined together where appropriate.

MODIFICATION EXAMPLE 1

In the first embodiment, the determination unit 43 calculates the difference between the reference resistance value and the measured resistance value and determines whether the thermal head has been replaced or not on this basis. In the second embodiment, the determination unit 43 compares the distribution of the reference resistance values with the distribution of the measured resistance values and determines whether the thermal head has been replaced or not on this basis. In another embodiment, the determination unit 43 may use a least square error method with the reference resistance value and the measured resistance value to determine whether the thermal head has been replaced.

MODIFICATION EXAMPLE 2

In the first and second embodiments, when the determination unit 43 detects that the thermal head has been replaced, the registration unit 42 registers, as the reference resistance value, the resistance value measured by the measuring unit 41 at that time. In another embodiment, the registration unit 42 may register the resistance value measured by the measuring unit 41 as the reference resistance value every time the resistance value is measured. Also, the determination unit 43 may detect whether the thermal head has been replaced based on the trend in change between the reference resistance value (that is, the result of a previous measurement) and the resistance value of each of the heaters just measured by the measuring unit 41 (that is, the result of the most recent measurement). This can achieve the same or substantially the same effects as those of the first and second embodiments.

MODIFICATION EXAMPLE 3

In one modified embodiment, for example, the measuring unit 41 may store the measured resistance value of each of the heaters as measured by the measuring unit 41 as a table in the auxiliary memory device 35. The determination unit 43 may refer to the stored table to analyze the trend or changes in measured values and determine whether the thermal head has been replaced, based on analysis trends or changes. This can achieve the same or substantially the same effects as those of the first and second embodiments.

A control program to be executed in the printer 1 may be recorded in a non-transitory computer-readable recording medium such as a CD-ROM. The control program may also or instead be stored on a computer connected to a network, such as the Internet, and may be downloaded via the network. The control program may also be accessed via a network, such as the Internet.

While certain embodiments of the present disclosure has been described, these embodiments are presented by way of example only and are not intended to limit the scope of the disclosure. The embodiments of the disclosure can be carried out in various other forms and can include various omissions, substitutions, replacements, changes and modifications without departing from the spirit and scope of the disclosure. The embodiment and the modifications thereof are included in the spirit and scope of the present disclosure and also included in the scope of the accompanying claims and their equivalents are intended to cover such forms and modifications as would fall within the scope and spirit of the disclosure.

What is claimed is:

1. A printer, comprising:

a printhead including a plurality of heaters arranged a row;

a roll-type paper feeder configured to supply paper from a roll to the printhead for printing;

a memory device configured to store reference resistance values for the plurality of heaters and an accumulated distance traveled value varying with a cumulative length of paper printed by the printhead; and a processor configured to:

acquire a measured resistance value for each of the heaters in the plurality of heaters;

detect whether the printhead has been changed since a previous use based on differences in the measured resistance values from the stored reference resistance values; and the accumulated distance traveled value in the memory device if it is detected that the printhead has been changed.

2. The printer according to claim 1, wherein the cumulative length is a value corresponding to a length of paper fed from the roll-type paper feeder.

3. The printer according to claim 2, wherein the roll-type paper feeder includes a platen configured to rotate and a stepping motor configured to rotate the platen, and the paper from the roll is fed between the platen and the printhead.

4. The printer according to claim 3, wherein the accumulated distance traveled value is a number of steps made by the stepping motor.

5. The printer according to claim 3, wherein the accumulated distance traveled value is a number of rotations of the platen.

6. The printer according to claim 1, wherein the processor is further configured to issue a notification command if the printhead has been detected as changed.

7. The printer according to claim 1, wherein the printhead is a thermal head.

8. The printer according to claim 1, wherein the processor is further configured to update the reference resistance values stored in the memory device to the most recent measured resistance values if a change of the printhead is detected.

9. The printer according to claim 1, wherein the resistance values for each of the heaters is measured in a startup operation of the printer.

10. The printer according to claim 1, wherein the processor detects whether the printhead has been changed by comparing a distribution in the measured resistance values for the plurality of heaters to a distribution in the stored reference resistance values for the plurality of heaters.

11. The printer according to claim 1, wherein the processor detects whether the printhead has been changed based on differences between the measured resistance value and the stored reference resistance value for every heater in the plurality of heaters.

12. A method for a printer with a thermal printhead that includes a plurality of heaters, the method comprising:

storing reference resistance values for a plurality of heaters of a thermal printhead;

storing an accumulated distance traveled value varying with a cumulative length of paper printed by the thermal printhead;

acquiring a measured resistance value for each heater in the plurality of heaters in the thermal printhead;

detecting whether the thermal printhead has been changed since a previous use based on differences in the measured resistance values from the stored reference resistance values; and resetting the stored accumulated distance traveled value when it is detected that the thermal printhead has been changed.

13. The method according to claim 12, wherein the cumulative length is a value corresponding to a length of paper fed from a roll-type paper feeder to the thermal printhead for printing.

14. The method according to claim 12, wherein the accumulated distance traveled value is a number of stepping motor steps configured to rotate a platen of a roll-type paper feeder.

15. The method according to claim 12, wherein the accumulated distance traveled value is a number of rotations of a platen of a roll-type paper feeder.

16. The method according to claim 12, further comprising:

issuing a notification command when the thermal printhead has been detected as changed.

17. The method according to claim 12, further comprising:

updating the stored reference resistance values to the most recent measured resistance values if a change of the thermal printhead is detected.

* * * * *